US006000497A

United States Patent [19]

Kain et al.

[11] Patent Number: 6,000,497

[45] Date of Patent: Dec. 14, 1999

[54] DETACHABLE TRAY FOR STEP STOOL

[75] Inventors: James M. Kain, Tipp City, Ohio; Raymond P. King, Columbus, Ind.

[73] Assignee: Cosco, Inc., Columbus, Ind.

[21] Appl. No.: 08/780,875

[22] Filed: Jan. 9, 1997

[51] Int. Cl.[6] ..... E06C 7/14

[52] U.S. Cl. ..... 182/129; 248/238

[58] Field of Search ..... 182/129, 120; 248/210, 238

[56] References Cited

U.S. PATENT DOCUMENTS

| | | | |
|---|---|---|---|
| D. 273,996 | 5/1984 | Rasler . | |
| D. 284,513 | 7/1986 | Dyer . | |
| D. 286,574 | 11/1986 | McMillin . | |
| D. 300,252 | 3/1989 | Schmitt . | |
| D. 300,563 | 4/1989 | Burkhart . | |
| D. 310,884 | 9/1990 | Patton et al. . | |
| D. 334,240 | 3/1993 | Huffine . | |
| 806,162 | 12/1905 | Milbrandt | 182/120 |
| 2,470,053 | 5/1949 | Salisbury | 182/129 |
| 2,805,104 | 9/1957 | Johnson | 182/120 |
| 2,899,011 | 8/1959 | Babits | 182/120 |
| 3,020,972 | 2/1962 | Hockett . | |
| 3,115,214 | 12/1963 | Roberts | 182/120 |
| 3,294,197 | 12/1966 | Kwiatkowski | 182/120 |
| 4,085,819 | 4/1978 | Ohnstad . | |
| 4,261,435 | 4/1981 | Winter . | |
| 4,276,955 | 7/1981 | Hickman | 182/129 |
| 4,310,134 | 1/1982 | Schopp et al. . | |
| 4,437,544 | 3/1984 | Anderson et al. . | |
| 4,460,063 | 7/1984 | Casada . | |
| 4,480,810 | 11/1984 | Hall | 182/129 |
| 4,589,521 | 5/1986 | Finster et al. . | |
| 4,653,713 | 3/1987 | Hamilton . | |
| 4,730,802 | 3/1988 | Chatham et al. . | |
| 4,874,147 | 10/1989 | Ory et al. . | |
| 4,979,590 | 12/1990 | Bailey . | |
| 5,052,581 | 10/1991 | Christ et al. . | |
| 5,120,013 | 6/1992 | Sweeney . | |
| 5,123,620 | 6/1992 | Bourne . | |
| 5,259,480 | 11/1993 | Bartnicki et al. . | |
| 5,333,823 | 8/1994 | Joseph . | |
| 5,342,008 | 8/1994 | Kay . | |
| 5,358,070 | 10/1994 | Bartnicki et al. . | |
| 5,503,245 | 4/1996 | Etesam . | |
| 5,505,302 | 4/1996 | Ferley . | |
| 5,511,753 | 4/1996 | Lage . | |

FOREIGN PATENT DOCUMENTS

| | | | |
|---|---|---|---|
| 1512155 | 6/1976 | United Kingdom | 182/121 |

*Primary Examiner*—Alvin Chin-Shue
*Attorney, Agent, or Firm*—Barnes & Thornburg

[57] ABSTRACT

A ladder assembly having a tray with a depending resilient mounting clip and support arms for supporting the tray in a horizontal use position and a storage position adjacent the ladder.

25 Claims, 7 Drawing Sheets

DETACHABLE TRAY FOR STEP STOOL

BACKGROUND AND SUMMARY OF THE INVENTION

The present invention relates to a tray that can mount to a ladder or similar device to provide a work surface on which objects can be placed, and particularly, to a tray that can be attached to and detached from a step stool frame without using any tools or mounting hardware separate from the tray. More particularly the present invention relates to a detachable tray for a step stool that, once mounted to the step stool, can pivot between a use position extending generally horizontally away from a frame of the step stool and a storage position lying against the frame of the step stool.

Trays that attach to ladders and step stools to provide a work surface on which objects can be placed are known in the art. Some trays that attach to ladders and step stools are rigidly mounted to a frame of the ladder or step stool so that the tray is fixed in a single position relative to the ladder or step stool. See, for example, U.S. Pat. Nos. 5,342,008 to Kay and 4,730,802 to Chatham et al. Other trays that attach to ladders and step stools may include movable linkage assemblies that connect the tray to the ladder or step stool. Such movable linkage assemblies typically can be adjusted to pivot the tray between a horizontal position and a storage position. See, for example, U.S. Pat. No. 5,120,013 to Sweeney.

Some trays that attach to ladders and step stools may include separate pieces that cooperate to form a single tray. See, for example, U.S. Pat. No. 4,979,590 to Bailey which discloses a platform for a ladder or step ladder including a first tray portion, a second tray portion pivotally coupled to the first tray portion and movable from a storage position where the tray portions overly each other to a work position where the second tray portion forms an extension to the first tray portion to provide a tray.

What is needed is a one-piece tray that can mount to a frame of a ladder, step stool, or similar device to form a ladder assembly and that can pivot relative to the frame between a horizontal use position and a storage position while mounted to the frame. A tray that can be mounted to a step easily by consumers without tools and that includes a surface engaging the frame to support the tray in the use position wherein a shelf of the tray extends generally horizontally away from the frame and a surface engaging the frame to support the tray in the storage position wherein the shelf of the tray is positioned to lie adjacent to the frame would provide many advantages to consumers.

According to the present invention, a tray is provided for attachment to and detachment from the frame of a ladder such as a step ladder or step stool. The tray includes a shelf having a curved surface that provides rotative bearing engagement between the tray and the ladder frame during pivoting movement of the tray relative to the ladder frame between a use position in which the shelf extends horizontally away from the ladder frame and a storage position in which the shelf is positioned to lie adjacent to the ladder frame. The curved surface is configured to retain the tray in engagement with the ladder frame during pivoting movement of the tray between the use and storage positions.

The tray further includes a support arm fixed to the shelf and arranged to engage the ladder frame to support the tray in both of the use and storage positions. The support arm includes a first support surface that engages the frame when the tray is in the use position to support the tray in the use position. The support arm also includes a second support surface that engages the frame when the tray is in the storage position to hold the tray in the storage position. The first support surface of the support arm is horizontally and vertically spaced apart from the curved surface of the shelf.

In preferred embodiments, a one-piece tray is mountable to a frame of a step stool without using tools or additional hardware and is detachable from the step stool frame without using tools. The step stool includes a U-shaped frame member having a horizontal strut and a pair of spaced-apart legs that extend generally downwardly from opposite ends of the horizontal strut. The tray includes a shelf that is formed to include a top work surface, a front edge, a rear edge, a first side, and a second side. In addition, the tray includes a first support arm appended to the first side of the shelf and a second support arm appended to the second side of the shelf.

The tray also includes a pair of spaced-apart mounting clips appended to a bottom portion of the shelf of the tray adjacent to the front edge of the shelf. The mounting clips are formed so that the tray can mount to the horizontal strut of the U-shaped frame member between the downwardly-extending legs. Each mounting clip cooperates with the bottom portion of the shelf to define a curved surface for engaging the horizontal strut of the step stool to provide rotative bearing engagement between the tray and the step stool frame during pivoting movement of the tray relative to the step stool frame between the use and storage positions.

The horizontal strut has a round cross-section and the mounting clips are generally C-shaped so that the mounting clips grasp the horizontal strut at the curved surface defined by the mounting clips and bottom portion of the tray to allow the tray to pivot relative to the frame member between the horizontal use position and the storage position. The tray can be attached to and detached from the horizontal strut of the step stool easily by a consumer without using tools or additional mounting hardware merely by moving the tray relative to the step stool to engage or disengage the tray mounting clips and the horizontal strut of the step stool.

Each of the legs of the U-shaped frame member includes a rear surface facing away from a person standing on the step stool and each of the first and second support arms includes a front support surface that engages respective rear surfaces of the legs to support the tray in the use position. When the tray is in the use position, the top work surface of the shelf of the tray faces generally upwardly and a portion of the bottom surface adjacent to the front edge of the shelf rests upon a top surface of the horizontal strut of the U-shaped frame member.

Each of the legs of the U-shaped frame member includes a front surface facing toward a person standing on the step stool. Each of the first and second support arms also includes a top support surface that faces generally upwardly when the tray is in the use position. Each of the top support surfaces of the first and second support arms engage respective front surfaces of the legs when the tray is in the storage position so that the tray hangs generally downwardly from the horizontal strut of the U-shaped frame member in parallel relation with the legs of the U-shaped frame member. In addition, the shelf of the tray is positioned to lie generally between the legs of the U-shaped frame member so that the first and second sides of the shelf are adjacent to respective legs of the U-shaped frame member, when the tray is in the storage position.

The first and second support arms are appended to first and second spacers, respectively, which are coupled to respective first and second sides of the shelf. The spacers position each support arm in an offset arrangement so that the first and second support arms are spaced apart from the bottom surface of the shelf of the tray. The offset arrangement allows the support arms to engage the rear surface of the frame member legs when the tray is in the use position and to engage the front surface of the frame member legs when the tray is in the storage position. As a result of the offset configuration of the first and second support arms relative to the shelf of the tray, the tray must be pivoted over the top of the horizontal strut through an angle that is greater than one hundred eighty degrees (180°) when the tray is moved between the use and storage positions.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 9 is a perspective view of the tray and step stool of FIG. 1 showing the tray lowered over a horizontal strut of a frame of the step stool while the tray is at an angle relative to the step stool so that a pocket formed between one of the support arms and the shelf receives the horizontal strut, and the tray being swingable through the angle into contact with the horizontal strut as indicated by the arrow so that the bottom portion of the tray abuts the horizontal strut;

FIG. 10 is a front elevation view of the tray and the horizontal strut of the step stool of FIG. 9 showing the tray in a slightly off-center position relative to the frame of the step stool, the bottom surface of the tray abutting the horizontal strut, and the curved surfaces defined by the mounting clips and bottom surface of the tray positioned to lie beneath the horizontal strut;

FIG. 11 is a view similar to FIG. 10 showing the tray moved horizontally from the off-center position to the right (in the direction of the single arrow) into a center position while the bottom surface of the tray abuts the horizontal strut, and showing the tray moved upwardly (in the direction of the two arrows) relative to the horizontal strut into an upright installed position wherein the mounting clips simultaneously grasp the horizontal strut of the step stool frame so that the curved surfaces provide rotative bearing engagement between the tray and the horizontal strut of the step stool frame;

DETAILED DESCRIPTION OF THE DRAWINGS

Figure 1:
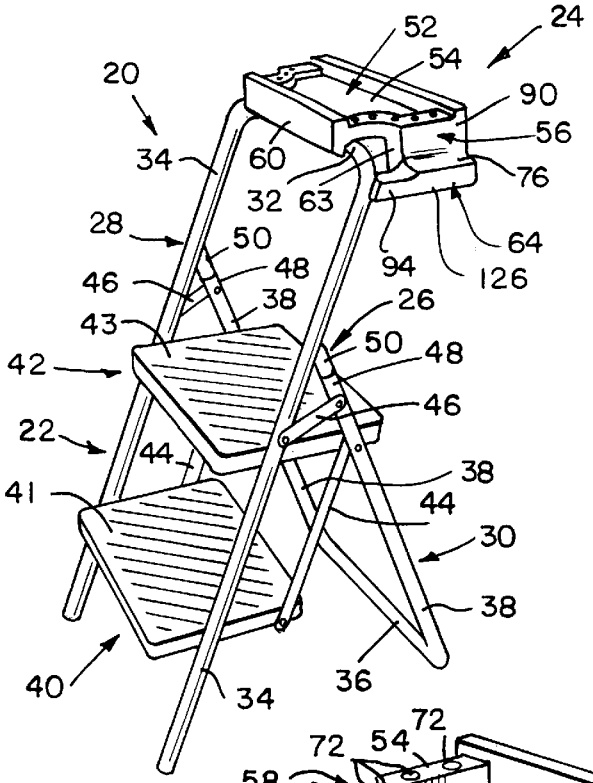
FIG. 1 is a perspective view of a ladder assembly in accordance with the present invention showing a detachable tray mounted to a step stool and moved to a use position and showing a left-side bottom portion of the tray grasping a horizontal strut at the top of the step stool frame and a first support arm engaging a leg depending from the horizontal strut to support the tray in the horizontal use position.

A ladder assembly 20 includes a step stool 22 and a tray 24 in accordance with the present invention mounted to step stool 22, as shown in FIG. 1. Step stool 22 includes a frame 26 having a tall front U-shaped frame member 28 and a short rear U-shaped frame member 30. Frame member 28 includes a horizontal strut 32, shown best in FIGS. 9–11. Frame member 28 also includes a pair of spaced-apart front legs 34 appended to opposite ends of horizontal strut 32 and extending generally downwardly therefrom, as shown in FIG. 1. U-shaped frame member 30 includes a horizontal base 36 for engaging a floor and a pair of spaced-apart rear legs 38 appended to opposite ends of horizontal base 36 and extending generally upwardly therefrom to engage legs 34 of U-shaped frame member 28 when step stool 28 is erect and in use.

Figure 9:
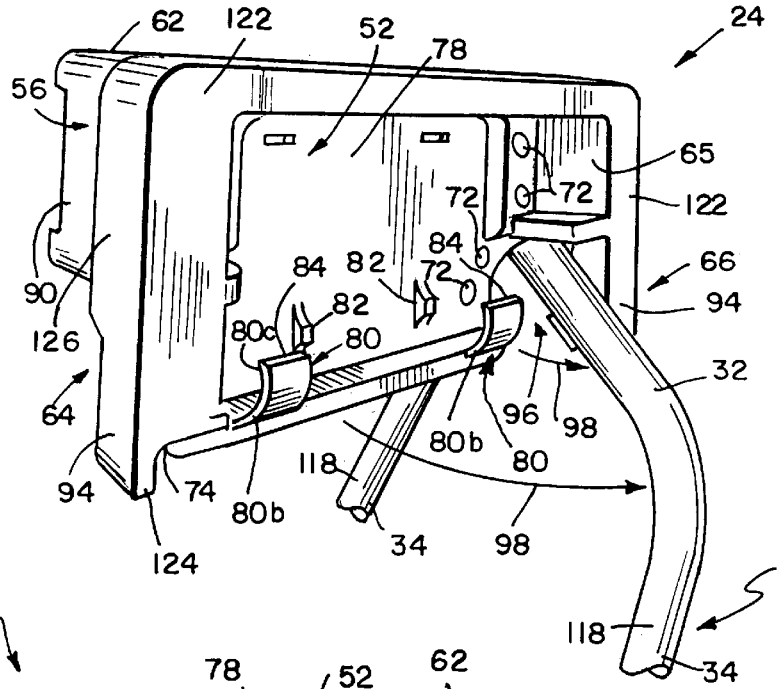
FIGS. 9–11 show a tray mounting sequence in which a consumer attaches the tray to the step stool frame without using tools or additional mounting hardware.
Figure 10:
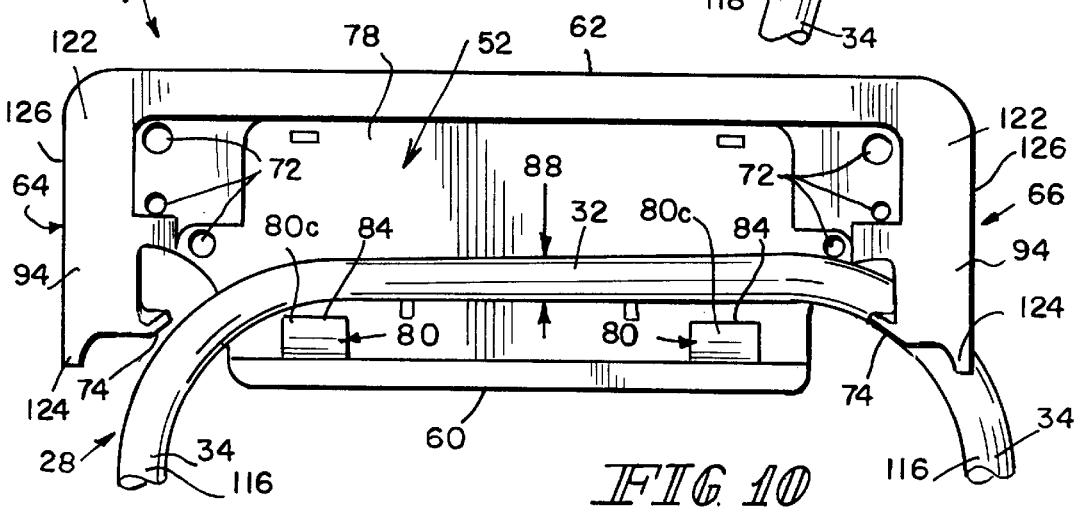
Figure 11:
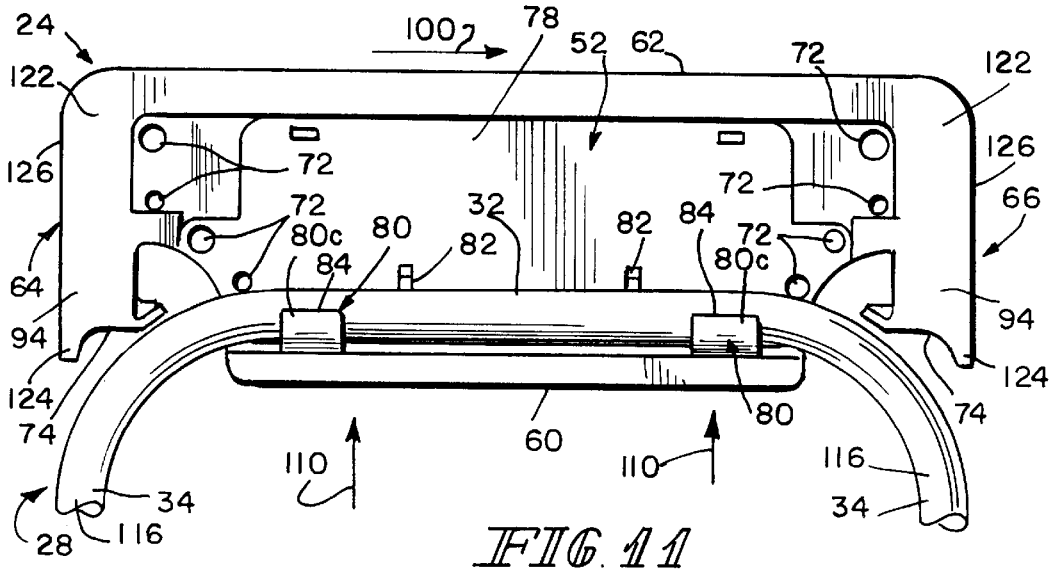

Tray 24 can be attached to horizontal strut 32 of step stool 22 quickly and easily by a consumer without using tools or additional mounting hardware as shown, for example, in FIGS. 9–11. Once attached, tray 24 can be pivoted on horizontal strut 32 through an angle of more than one hundred eighty degrees (180°) between a horizontal use position as shown, for example, in FIG. 13 and storage position as shown, for example, in FIG. 12.

Step stool 22 includes a first step 40 having a top surface 41 and a second step 42 having a top surface 43, as shown in FIG. 1. Second step 42 is pivotably coupled to front legs 34 of U-shaped frame member 28 and to rear legs 38 of U-shaped frame member 30. First step 40 is pivotably coupled to front legs 34 below second step 42. Step stool 22 includes a pair of spaced-apart support links 44 that pivotably connect first step 40 to rear legs 38. In addition, step stool 22 includes a pair of spaced-apart connecting links 46 that pivotably connect an upper end 48 of each rear leg 38 to a middle portion of respective front legs 34, as shown in FIG. 1.

Front and rear U-shaped frame members 28, 30 can fold between an opened position, shown in FIG. 1, wherein base 36 of frame member 30 is spaced apart from front legs 34 of frame member 28 and a collapsed position (not shown) wherein rear legs 38 of frame member 30 are adjacent to respective front legs 34 of frame member 28. An end cap 50 is mounted to upper end 48 of each rear leg 38 and each end cap 50 abuts a respective front leg 34 of frame member 28 when members 28, 30 are in the opened position.

First and second steps 40, 42 cooperate with links 44, 46 to guide the movement of frame members 28, 30 when frame members 28, 30 are folded between the opened and collapsed positions. When frame members 28, 30 are in the opened position, top surfaces 41, 43 of respective first and second steps 40, 42 face generally upwardly, as shown in FIG. 1, and when frame members 28, 30 are in the collapsed position, top surfaces 41, 43 first and second steps 40, 42 face away from frame member 28.

Figure 2:
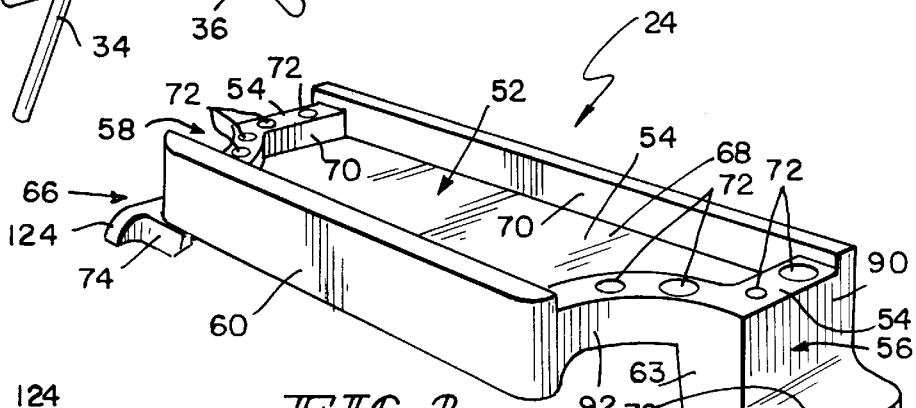
FIG. 2 is a perspective view of the tray of FIG. 1 showing a shelf of the tray having a top work surface extending between first and second sides of the shelf and first and second support arms appended to first and second sides of the tray, respectively, and positioned to lie below the top work surface in a horizontally spaced-apart offset configuration.
Figure 4:
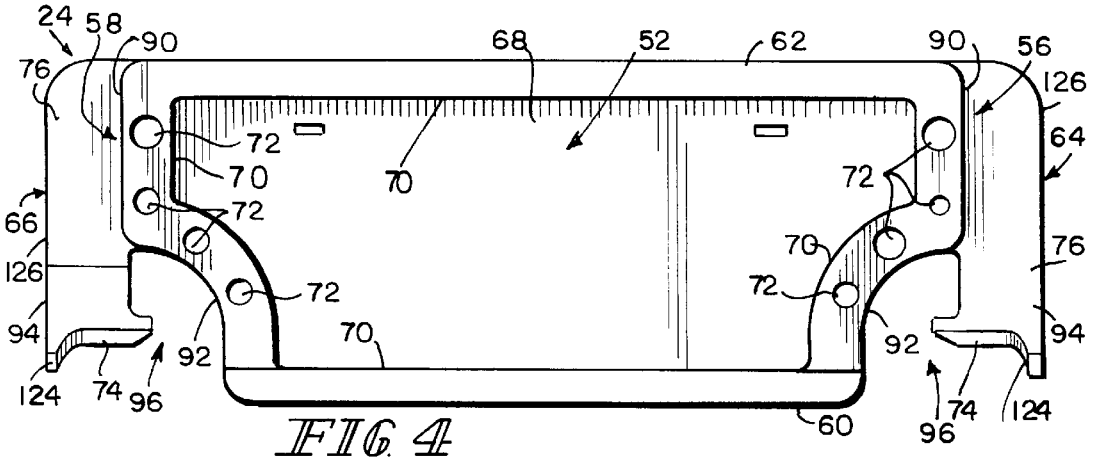
FIG. 4 is a top plan view of the tray of FIG. 3 showing the top work surface of the shelf and top support surfaces of the support arms positioned to lie on each side of the shelf.
Figure 5:
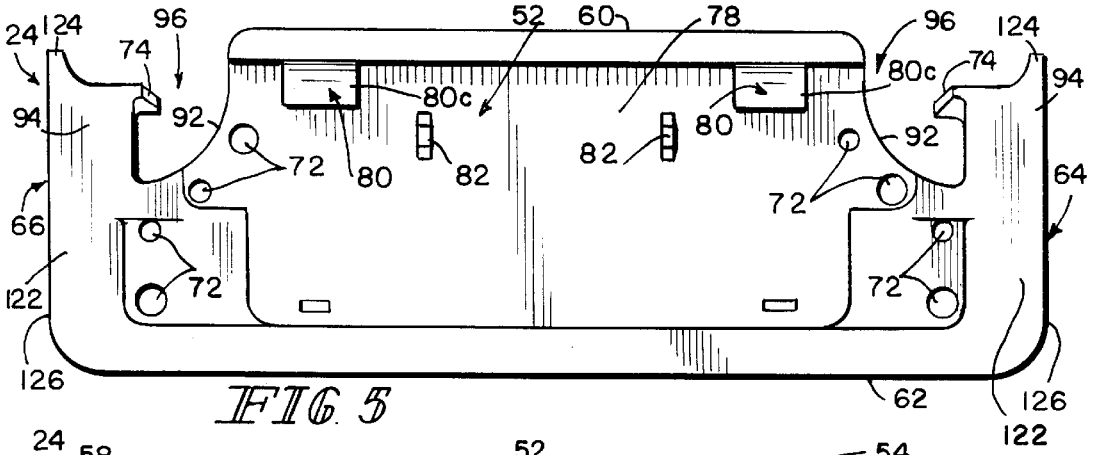
FIG. 5 is a bottom plan view of the tray of FIG. 4 showing the undersurface of the shelf and bottom surfaces of the support arms.

Tray 24 includes a shelf 52 having a top work surface 54 that extends between a first side 56, a second side 58, a front edge 60, and a rear edge 62 of shelf 52 as shown best in FIG. 4. Top work surface 54 is defined by a shelf base 68 and a perimitral retaining wall 70 extends upwardly from shelf base 68 for retaining objects (not shown) that are stored on tray 24. In addition, shelf 52 is formed to include a plurality of tool-receiving apertures 72 as shown in FIGS. 2, 4, and 5. Apertures 72 are of varying diameters allowing screwdrivers and other tools (not shown) to be inserted into apertures 72 and supported by tray 24.

Figure 3:
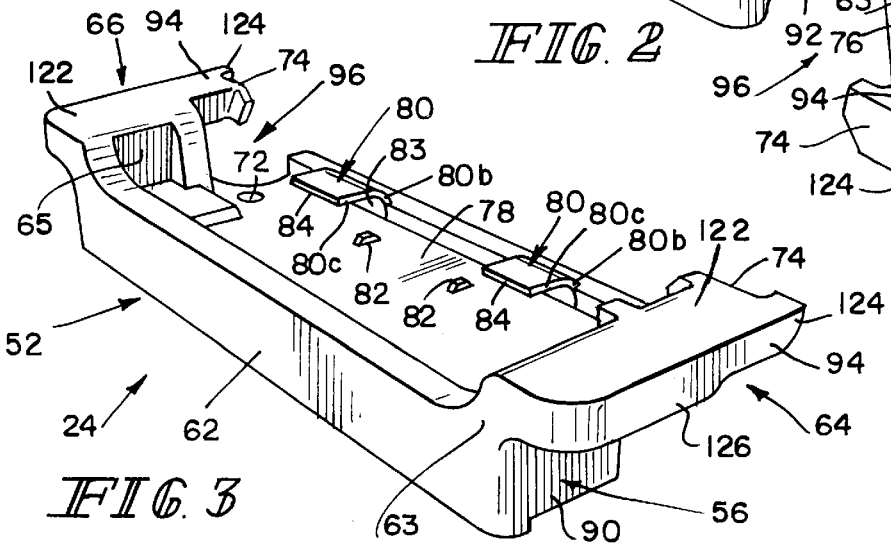
FIG. 3 is a perspective view of the tray similar to FIG. 2 showing an undersurface of the shelf and mounting clips appended to the undersurface adjacent to a front edge of the tray.
Figure 6:
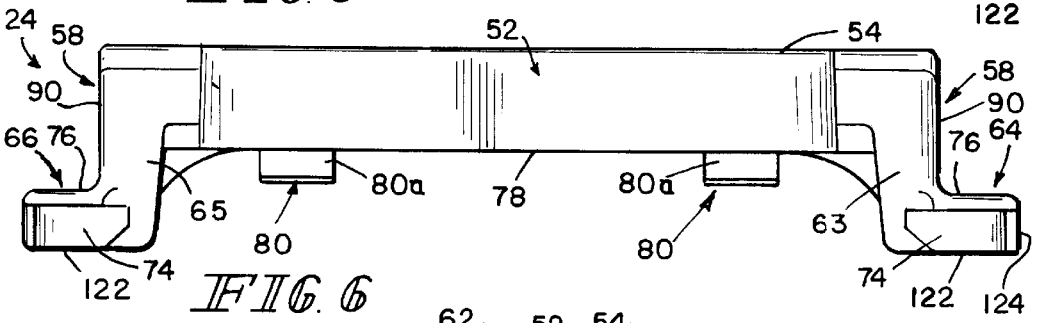
FIG. 6 is a front elevation view of the tray of FIG. 5 showing a front edge of the shelf and showing first and second spacers extending downwardly from opposite sides of the shelf to position front support surfaces of the support arms below the front edge of the shelf.
Figure 7:
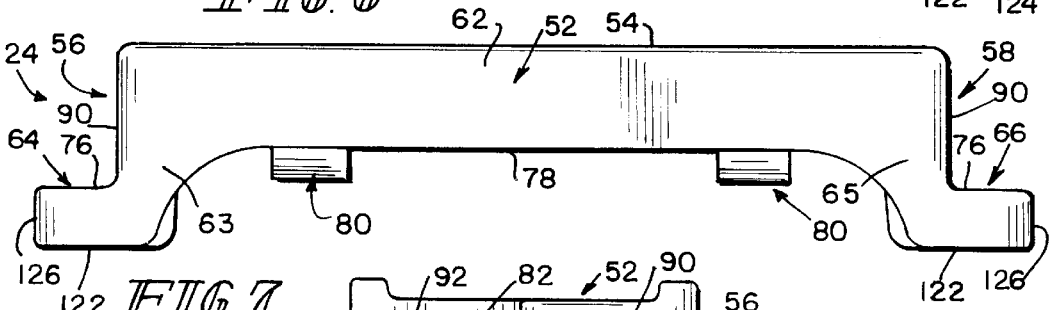
FIG. 7 is a rear elevation view of the tray of FIG. 6 showing a rear edge of the tray and rear surfaces of the support arms.

Tray 24 includes a first spacer 63 appended to first side 56 of shelf 52 and a second spacer 65 appended to second side 58 of shelf 52 as shown in FIGS. 3, 6, and 7. First and second spacers 63, 65, extend away from shelf 52. A first support arm 64 is appended to first spacer 63 and a second support arm 66 is appended to second spacer 65.

First and second support arms 64, 66 each include a front support surface 74 and a top support surface 76. Front support surfaces 74 of support arms 64, 66 face in substantially the same direction as front edge 60 of shelf 52 and top support surfaces 76 of support arms 64, 66 face in substantially the same direction as work surface 54 as shown in FIGS. 2–8. In addition, spacers 63, 65 position respective support arms 64, 66 in an offset arrangement relative to shelf 52 so that top support surfaces 76 of support arms 64, 66 are horizontally and vertically spaced apart from top work surface 54 of shelf 52 and so that front support surfaces 74 of support arms 64, 66 are horizontally and vertically spaced apart from front edge 60 of shelf 52, as shown in FIGS. 2, 3, 5, 6, 14, and 17.

Shelf base 68 includes an undersurface 78 that is substantially parallel with top work surface 54 and that extends between first side 56, second side 58, front edge 60, and rear edge 58 of shelf 52 as shown in FIG. 3. Tray 24 includes a pair of spaced-apart mounting clips 80 that are appended to undersurface 78 of shelf base 68 adjacent to front edge 60 of shelf 52 as shown in FIGS. 3 and 6–11. Each mounting clip 80 includes a first portion **80*a* that projects away from undersurface 78 in parallel relation with front edge 60, a second portion 80*b* that curves away from front edge 60, and a third portion 80*c* that projects in parallel relation with undersurface 78 of shelf base 68. Third portion 80*c* of mounting clip 80 terminates at a distal end 84 as shown best in FIG. 8**.

Figure 8:
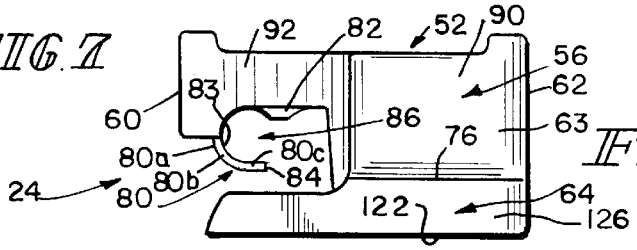
FIG. 8 is a side elevation view of the tray of FIG. 7 showing the support arms including frontwardly-extending portions that are positioned to lie below the mounting clips and the mounting clips cooperating with the bottom portion of the tray to define a curved surface for engaging the horizontal strut of the step stool to provide rotative bearing engagement between the tray and the step stool frame during pivoting movement of the tray relative to the step stool frame.

Shelf base 68 is formed to include a pair of tabs 82 that project away from undersurface 78 by a slight amount as shown in FIGS. 3, 5, 8, 9, and 11. Tabs 82 are positioned to lie between front and rear edges 60, 62 of shelf 52 so as to cooperate with undersurface 78 and mounting clips 80 to create a generally C-shaped profile as shown in FIG. 8. Tabs 82 cooperate with distal ends 84 of mounting clips 80 to provide a profile opening 86 that receives horizontal strut 32 of U-shaped frame member 28 when tray 24 is mounted to step stool 22.

First and second sides 56, 58 of shelf 52 each include a straight wall 90 and a curved wall 92 as shown in FIGS. 2–5, 15, 16, and 18. Straight wall 90 of first and second sides 56, 58 extends downwardly from top work surface 54 and integrally connects to respective first and second spacers 63, 65 which hold support arms 64, 66 in their offset arrangements as shown in FIG. 2. Curved wall 92 extends from top work surface 54 to undersurface 78 of shelf 52 and extends from respective straight walls 90 to front edge 60 of shelf 52.

Each support arm 64, 66 includes a frontwardly-extending portion 94 that extends away from respective spacers 63, 65 of first and second sides 56, 58 below respective curved walls 92 as shown best in FIG. 2. Frontwardly-extending portion 94 of each support arm 64, 66 cooperates with spacers 63, 65 and curved wall 92 of respective first and second sides 56, 58 of shelf 52 to form a pocket 96 as shown in FIGS. 2–5, and 9–11.

Tray 24 can be mounted to step stool 22 to form ladder assembly 20 as previously described and as illustrated in FIGS. 9–11. To mount tray 24 to step stool 22, a user can hold tray 24 above step stool 22 at an angle relative to horizontal strut 32 and then can lower tray 24 relative to step stool 22 so that horizontal strut 32 is received within one of pockets 96 as shown in FIG. 9. The user then can swing tray 24 in a direction indicated by arrows 98, shown in FIG. 9, until undersurface 78 of shelf base 68 abuts strut 32 having both mounting clips 80 positioned to lie below horizontal strut 32 and having tray 24 in an off-center position as shown in FIG. 10.

Next, the user can slide tray 24 relative to strut 32 in a horizontal direction indicated by arrow 100 from the off-center position to a centered position wherein tray 24 is centered between front legs 34 of U-shaped frame member 28. When tray 24 is in the centered position, support arms 64, 66 are generally aligned with respective legs 34 of U-shaped frame member as shown in FIG. 11. After the user has moved tray 24 to the centered position, the user then can lift tray 24 in an upward direction indicated by arrows 110 to an upright installed position, shown in FIGS. 11 and 12. When the user moves tray 24 upwardly into the upright installed position, strut 32 passes between tabs 82 and distal ends 84 of mounting clips 80.

Horizontal strut 32 has a round cross section with an outer diameter 88, shown in FIG. 10, that is slightly larger than profile opening 86. Mounting clips 80 are made of a resilient material and deflect from an undeflected configuration to a deflected configuration when tray 24 is lifted from the centered position shown in FIG. 10 into the installed position shown in FIG. 11 so that profile opening 86 can expand to allow horizontal strut 32 to pass through opening 86. Once strut 32 has passed through opening 86, mounting clips 80 return to the undeflected configuration and cooperate with tabs 82 and undersurface 78 of shelf base 68 to grasp horizontal strut 32 of U-shaped frame member 28 so that tray 24 is mounted to step stool 22.

Figure 12:
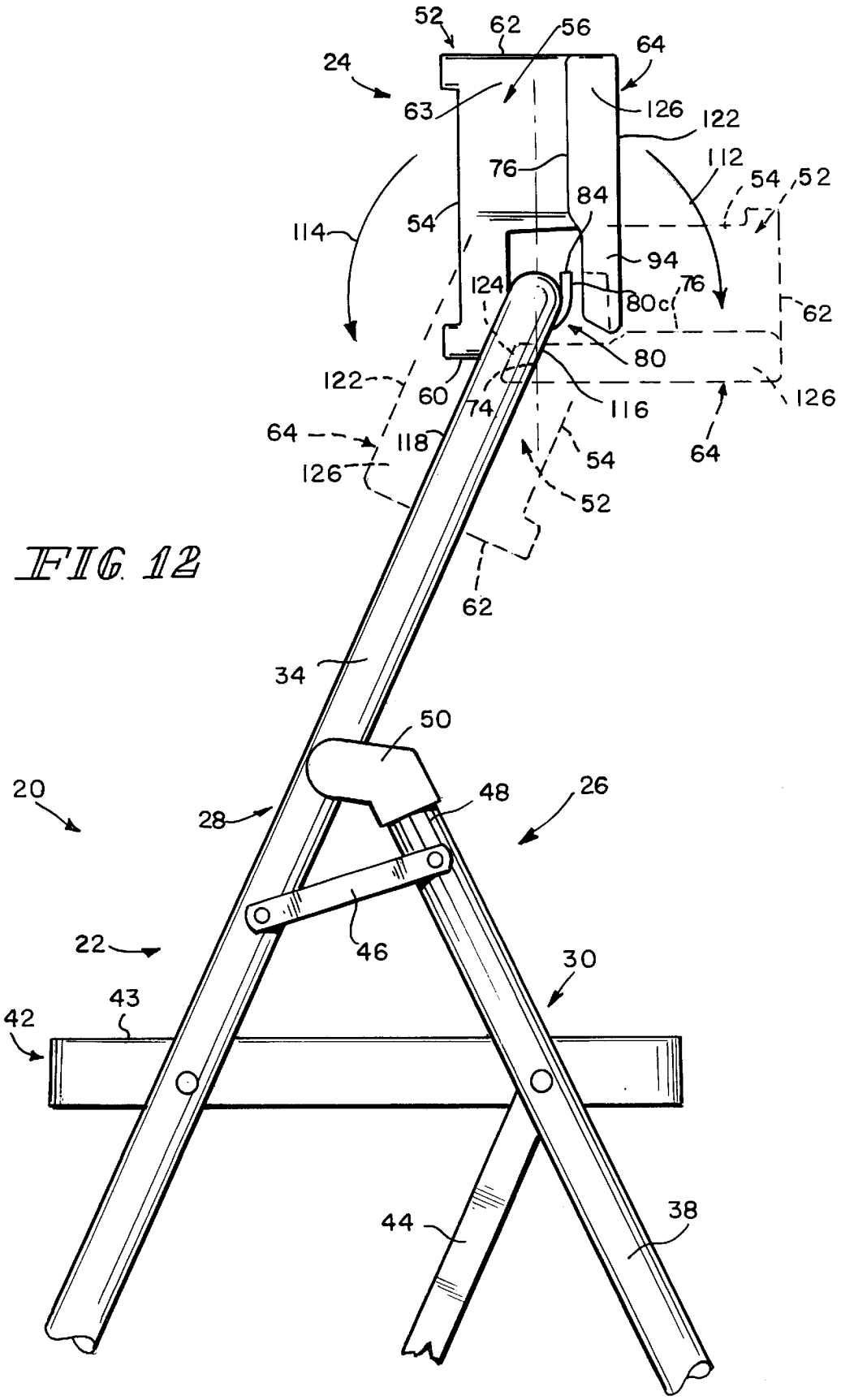
FIG. 12 is a side elevation view of the tray and step stool of FIG. 11 showing the tray in the upright installed position (in solid), the tray being pivotable from the installed position in a clockwise direction to a horizontal use position (in phantom) having the front support surfaces of each support arm engaging a rear surface of the step stool frame to support the tray in the use position, and the tray being pivotable from the installed position in a counterclockwise direction to an inclined storage position (in phantom) having the top support surfaces of each support arm engaging a front surface of the step stool frame.

When tray 24 is in the upright installed position, tray 24 is generally vertically oriented having work surface 54 of shelf 52 and top support surface 76 of support arms 64, 66 facing generally forwardly and having rear edge 62 of shelf 52 positioned to lie above front edge 60 of shelf 52 as shown best in FIG. 12. After moving tray 24 to the upright installed position, the user can pivot tray 24 in a rearward direction indicated by arrow 112 to a use position as shown in FIG. 12 (in phantom). Alternatively, the user can pivot tray 24 from the upright installed position in a forward direction indicated by arrow 114 to a storage position as also shown in FIG. 12 (in phantom).

Thus, mounting clips 80 allow tray to hook onto horizontal strut 32 of frame 26. In addition, each mounting clip 80 cooperates with undersurface 78 of shelf base 68 to provide a curved surface 83 that engages strut 32 when tray is mounted to step stool 22. Curved surfaces 83 provide rotative bearing engagement between tray 24 and strut 32 allowing tray 24 to pivot between the use position and the storage position when tray 24 is attached to strut 32.

Tray 24 can pivot in direction 112 until front support surface 74 of each support arm 64, 66 engages a rear surface 116 of respective legs 34 which stops pivoting movement of tray 24 in direction 112. Similarly, tray 24 can pivot in direction 114 until top support surface 76 of each support arm 64, 66 engages a front surface 118 of respective legs which stops pivoting movement of tray 24 in direction 114. Thus, engagement of support arms 64, 66 with legs 34 limits the angle through which tray 24 can pivot relative to horizontal strut 32. In addition, the alignment of support arms 64, 66 with respective legs 34 requires that tray 24 be pivoted over the top of horizontal strut 32 through an angle that is greater than one hundred eighty degrees (180°) when tray 24 is moved between the use and storage positions.

When tray 24 is in the use position, top work surface 54 of shelf 52 is horizontally oriented and faces generally upwardly and bottom portion 78 adjacent to front edge 60 of shelf 52 rests upon horizontal strut 32 so that mounting clips 80 hook around the front of strut 32 as shown in FIGS. 12–15. In addition, engagement of front support surfaces 74 of support arms 64, 66 with rear surfaces 116 of legs 34 in combination with mounting clips 80 hooking around the front of horizontal strut 32 supports tray 24 in the use position extending away from U-shaped frame member 28.

Figure 13:
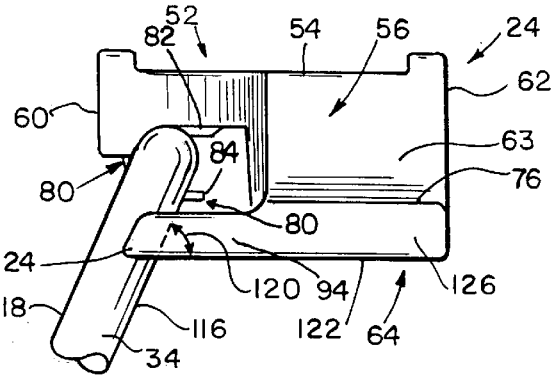
FIG. 13 is a side elevation view of the tray and step stool of FIG. 12 showing the tray in the horizontal use position having the front support surfaces of the support arms positioned below the mounting clips by the spacers and engaging the rear surface of the step stool frame so that the work surface of the tray faces generally upwardly.

When frame 26 of step stool 22 is in the opened position, legs 34 of U-shaped frame member 28 are angled, as shown in FIGS. 1 and 12, relative to a floor (not shown) on which step stool 22 sets. Front support surfaces 74 of support arms 64, 66 are each oriented at an angle 120 relative to a bottom surface 122 of each support arm 64, 66 as shown in FIG. 13. Angle 120 between front support surfaces 74 and bottom surfaces 122 of respective support arms 64, 66 compensates for the angle of legs 34 relative to the floor and maximizes the area of contact between front support surfaces 74 and rear surfaces 116 of legs 34. In addition, front support surfaces 74 of each support arm 64, 66 are spatially oriented relative to work surface 54 and relative to front and rear edges 60, 62 of shelf 52 so that work surface 54 faces generally upwardly when tray 24 is in the use position having front surfaces 74 of support arms 64, 66 engaging respective rear surfaces 116 of front legs 34.

Figure 14:
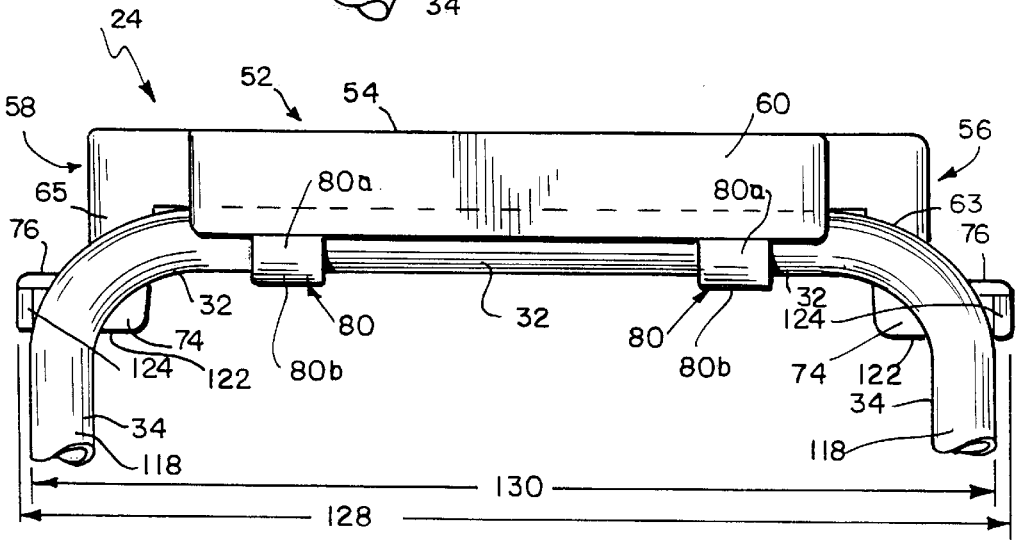
FIG. 14 is a front elevation view of the step stool of FIG. 13 showing the tray in the use position, the mounting clips grasping the horizontal strut, and the support arms being positioned to lie behind the step stool frame.
Figure 15:
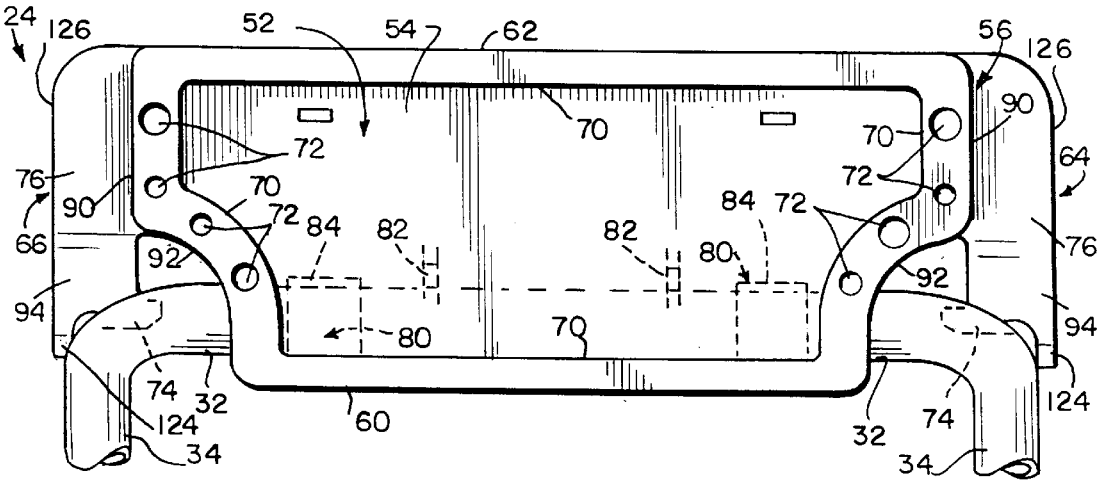
FIG. 15 is top plan view of the tray and step stool of FIG. 14 showing the tray in the use position, the mounting clips grasping the horizontal strut (in phantom), and the front support surfaces of the support arms engaging the rear surface of the step stool frame (in phantom)

Support arms 64, 66 each include an outer edge 126 and a distance 128 separates outer edges 126 of support arms 64, 66 as shown in FIG. 14. U-shaped frame member 28 has an outer width 130 that is less than distance 128 as also shown in FIG. 14. In addition, each support arm 64, 66 is formed to include a catch lip 124 adjacent to front support surfaces 74 as shown in FIGS. 2–6, 9–11, and 14–18. When tray 24 is in the use position, each catch lip 124 extends forwardly past respective rear surfaces 116 of legs 34 so that catch lips 124 cradle U-shaped frame member 28 and limit the amount by which tray 24 can horizontally slide relative to horizontal strut 32.

When tray 24 is in the storage position having top support surface 76 of each support arm 64, 66 engaging front surface 118 of a respective leg 34, tray 24 is supported in parallel relation with legs 34 as shown best in FIG. 12. In addition, front support surfaces 74 of support arms 64, 66 and front edge 62 of shelf 52 face generally upwardly while mounting clips 80 hook over the top of strut 32 when tray 24 is in the storage position so that tray 24 hangs generally downwardly from strut 32 as shown in FIGS. 16–18.

Figure 16:
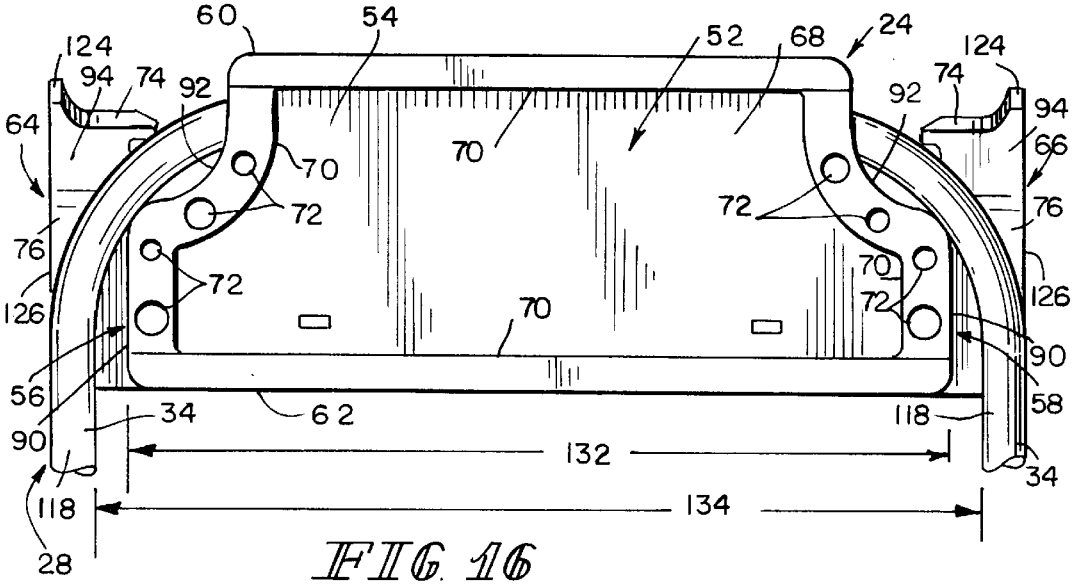
FIG. 16 is a rear elevation view of the tray and step stool of FIG. 13 showing the tray in the storage position, the work surface of the shelf extending upwardly beyond the horizontal strut behind the step stool frame, and the support arms being positioned to lie in front of the step stool frame adjacent to the front surface of the step stool frame.

A distance 132 separates first and second sides 56, 58 of shelf base 68 as shown in FIG. 16. In addition, U-shaped frame member 28 has an inner width 134 that is greater than distance 132 as also shown in FIG. 16. Because distance 130 separating first and second sides 56, 58 of shelf base 68 is less than inner width 134 of U-shaped frame member 28, top work surface 54 can pass between legs 34 of U-shaped frame member 28 when tray 24 pivots between the use position and the storage position. Of course, support arms 64, 66 cannot pivot between legs 34 because distance 128 between outer edges 126 of support arms 64, 66 is greater than outer width 130 of U-shaped frame member 28.

Figure 17:
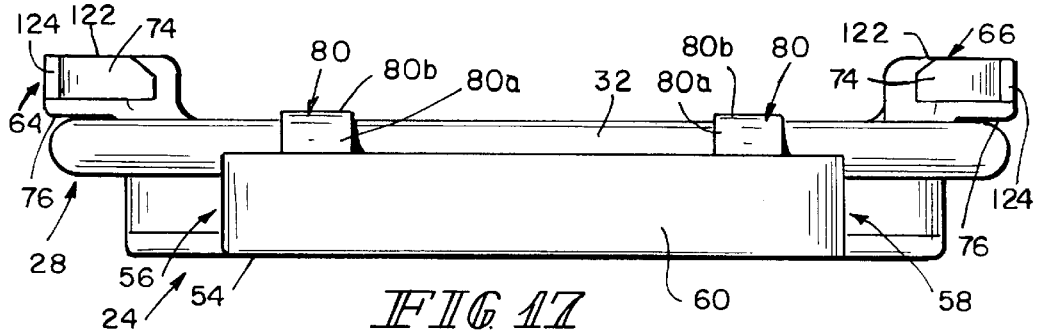
FIG. 17 is a top plan view of the tray and step stool of FIG. 15 showing the tray in the storage position, the mounting clips grasping the horizontal strut, the top support surfaces of the support arms engaging the front surface of the step stool frame, and the work surface of the tray being positioned to lie behind the step stool frame.
Figure 18:
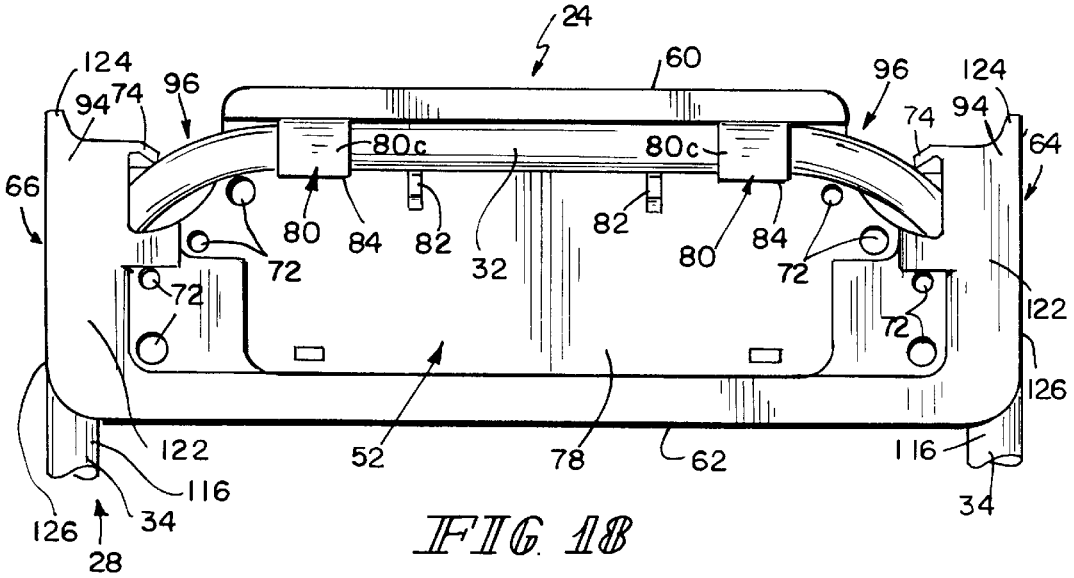
FIG. 18 is a front elevation view of the tray and step stool of FIG. 16 showing the tray in the storage position, the mounting clips grasping the horizontal strut, the bottom surface of the shelf being positioned to lie behind the horizontal strut, and the support arms engaging the front surface of the step stool frame.

As a result of the offset arrangement of support arms 64, 66 relative to shelf 52, work surface 54 of shelf 52 is positioned to lie behind U-shaped frame member 28 and support arms 64, 66 are positioned to lie in front of U-shaped frame member 28 when tray 24 is in the storage position as shown in FIGS. 16–18. In addition, first and second spacers 63, 65 of tray 24 are positioned to lie adjacent to respective legs 34 of U-shaped frame member 28. The proximity of first and second spacers 63, 65 with respective legs 34 of U-shaped frame member 28 limits the amount by which tray 24 can horizontally slide relative to horizontal strut 32 when tray 24 is in the storage position.

When tray 24 is in the storage position, elbow portions of U-shaped frame member 28 are positioned to lie adjacent to respective curved walls 92 of first and second sides 56, 58 of shelf 52 and each elbow portion extends through a respective pocket 96 of tray 24 as shown in FIGS. 16 and 18. Extension of elbow portions of U-shaped frame member 28 through respective pockets 96 of tray 24 prevents tray 24 from being detached from step stool 22 because first and second spacers 63, 65 of tray 24 engage the elbow portions to prevent upward lifting of tray 24 relative to horizontal strut 32.

Tray 24 can be detached from step stool 22 by reversal of the mounting steps described above with reference to FIGS. 9–11. For example, tray 24 can be pivoted to the upright installed position, shown in FIGS. 11 and 12, and then can be pushed downwardly relative to horizontal strut 32 so that horizontal strut 32 exits through profile opening 86 past mounting clips 80. Once mounting clips 80 are no longer grasping horizontal strut 32, tray 24 can be moved to the off-center position, shown in FIG. 10, and then swung away from U-shaped frame member 28 into an angled orientation relative to U-shaped frame member 28 as shown in FIG. 9. Once tray 24 is in the angled orientation, tray 24 can be lifted away from step stool 24 so that tray 24 is completely detached from step stool 22.

Thus, ladder assembly 20 includes a one-piece tray 24 that can be attached to and detached from horizontal strut 32 of U-shaped frame member 28. Once tray 24 is attached to horizontal strut 32, tray 24 can be pivoted to the use position wherein front support surfaces 74 of support arms 64, 66 engage respective rear surfaces 116 of legs 34 to support tray 24 in the use position. In addition, once tray 24 is attached to horizontal strut 32, tray 24 can be pivoted to the storage position wherein top support surfaces 76 of support arms 64, 66 engage respective front surfaces 118 of legs 34.

Figure 19:
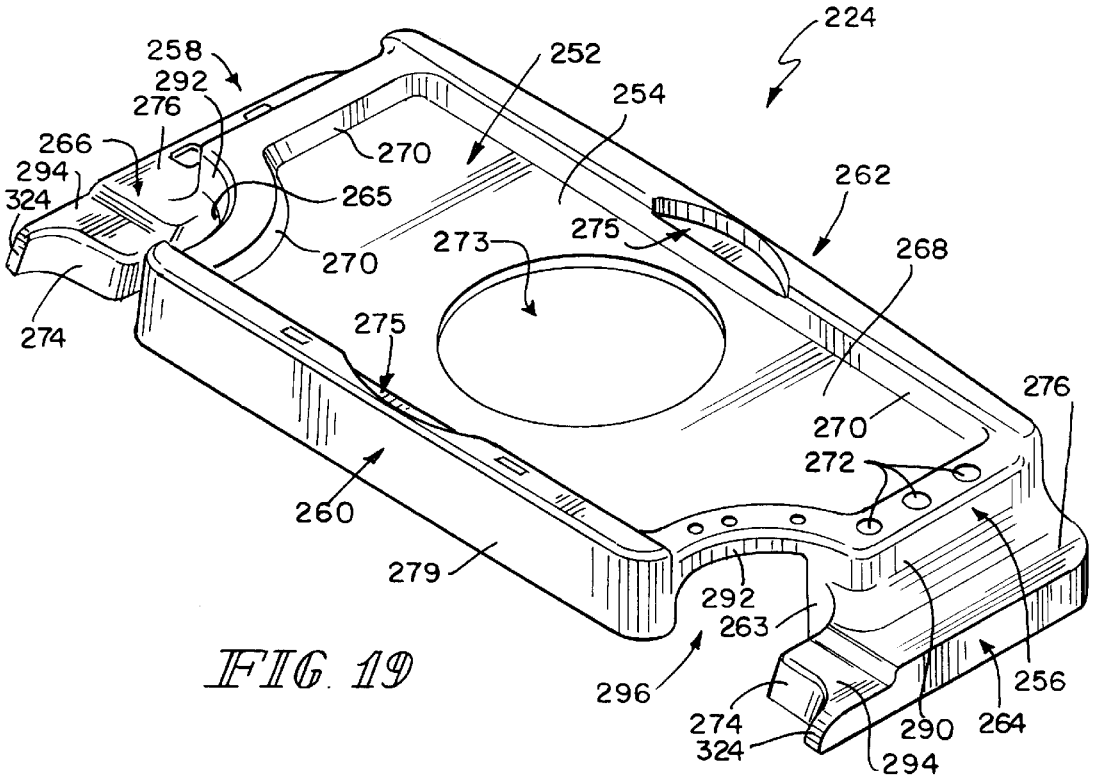
FIG. 19 is a perspective view of an alternative embodiment tray in accordance with the present invention showing a one-piece molded tray including a shelf and a pair of spaced-apart support arms, each support arm being coupled to the shelf in an offset arrangement by a respective spacer that extends downwardly from the shelf.
Figure 20:
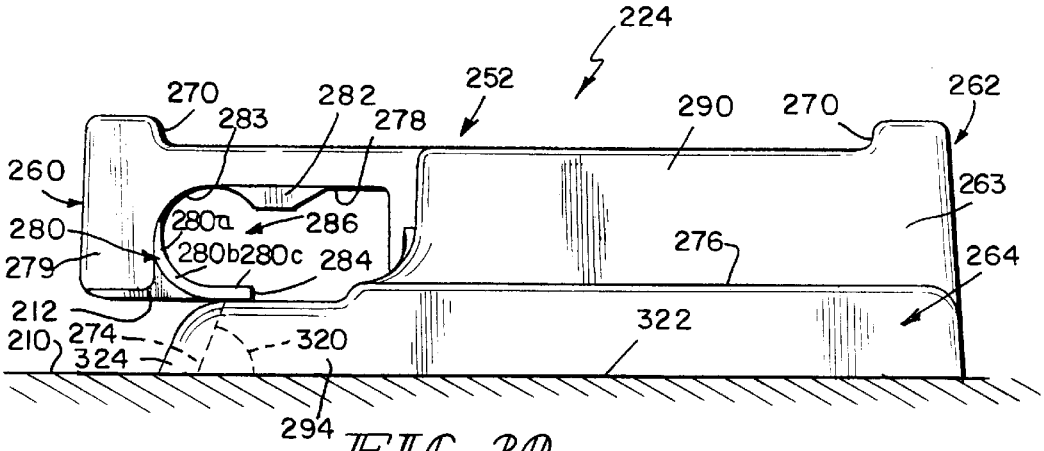
FIG. 20 is a side elevation view of tray of FIG. 19 showing the shelf being formed to include a mounting clip positioned to lie above a left-side end of the support arm, the shelf being formed to include a reinforcing web that assists in rigidifying the mounting clip, the support arms having a flat bottom surfaces, and the flat bottom surfaces of the support arm engaging a flat table surface so that shelf is stably supported in spaced-apart relation with the table surface.

An alternative embodiment tray 224 according to the present invention is shown in FIGS. 19 and 20. Tray 224 is a one-piece molded tray made of an engineering plastics material. Tray 224 includes a shelf 252 having a top work surface 254 that extends between a first side 256, a second side 258, a front edge 260, and a rear edge 262 of shelf 252 as shown best in FIG. 19. Top work surface 254 is defined by a shelf base 268 and a perimitral retaining wall 270 extends upwardly from shelf base 268 for retaining objects (not shown) that are stored on tray 224. In addition, shelf 252 is formed to include a plurality of tool-receiving apertures 272, a small paint can-receiving circular recess 273, and a pair of large paint can-receiving arcuate recesses 275.

Tray 224 includes a first spacer 263 appended to first side 256 of shelf 252 and a second spacer 265 appended to second side 258 of shelf 252 as shown in FIG. 19. First and second spacers 263, 265, extend away from shelf 252. A first support arm 264 is appended to first spacer 263 and a second support arm 266 is appended to second spacer 265. First and second spacers 263, 265 of tray 224 are similar to but smaller than first and second spacers 63, 65 of tray 24 so that support arms 264, 266 of tray 224 are closer to shelf 252 than support arms 64, 66 of tray 24 are to shelf 52.

First and second support arms 264, 266 each include a front support surface 274 that faces in substantially the same direction as front edge 260 of shelf 252 and a top support surface 276 that faces in substantially the same direction as work surface 254. In addition, spacers 263, 265 position respective support arms 264, 266 in an offset arrangement relative to shelf 252 so that top support surfaces 276 of support arms 264, 266 are horizontally and vertically spaced apart from top work surface 254 of shelf 252 and so that front support surfaces 274 of support arms 264, 266 are horizontally and vertically spaced apart from front edge 260 of shelf 252, as shown in FIGS. 19 and 20.

Shelf base 268 includes an undersurface 278 that is substantially parallel with top work surface 254 and that extends between first side 256, second side 258, front edge 260, and rear edge 258 of shelf 252. Tray 224 includes a pair of spaced-apart mounting clips 280 that are integrally appended to a downwardly-hanging portion 279 of shelf base 268 adjacent to front edge 260 of shelf 52. Each mounting clip 280 includes a first portion **280*a* that projects away from undersurface 278 substantially in parallel relation with front edge 260, a second portion 280*b* that curves away from front edge 260, and a third portion 280*c* that projects substantially in parallel relation with undersurface 278 of shelf base 268 as shown in FIG. 20. Third portion 280*c* of mounting clip 280 terminates at a distal end 284**.

Shelf base 268 is formed to include a pair of tabs 282 that project away from undersurface 278 by a slight amount as shown in FIG. 20. Tabs 282 are positioned to lie between front and rear edges 260, 262 of shelf 252 so as to cooperate with undersurface 278 and mounting clips 280 to create a generally C-shaped profile as also shown in FIG. 20. Tabs 282 cooperate with distal ends 284 of mounting clips 280 to provide a profile opening 286 that receives horizontal strut 32 of U-shaped frame member 28 when tray 224 is mounted to step stool 22.

First and second sides 256, 258 of shelf 252 each include a straight wall 290 and a curved wall 292 as shown in FIG. 19. Straight wall 290 of first and second sides 256, 258 extends downwardly from top work surface 254 and integrally connects to respective first and second spacers 263, 265 which hold support arms 264, 266 in their offset arrangements. Curved wall 292 extends from top work surface 254 to undersurface 278 of shelf 252 and extends from respective straight walls 290 to front edge 260 of shelf 252.

Each support arm 264, 266 includes a frontwardly-extending portion 294 that extends away from respective spacers 263, 265 of first and second sides 256, 258 below respective curved walls 292 as shown best in FIG. 20.

Frontwardly-extending portion 294 of each support arm 264, 266 cooperates with spacers 263, 265 and curved wall 292 of respective first and second sides 256, 258 of shelf 252 to form a pocket 296. Tray 224 can be attached to step stool 22 to form a ladder assembly (not shown) in a manner that is similar to the manner in which tray 24 is mounted to step stool 22 to form ladder assembly 20. In addition, tray 224 can be detached from step stool 22 in a manner that is similar to the manner in which tray 24 is detached from step stool 22.

Mounting clips 280 are made of a resilient material and portion 280*c* of each mounting clip 280 deflects from an undeflected configuration to a deflected configuration when tray 224 is mounted onto horizontal strut 32 of step stool 22 so that profile opening 286 can expand to allow horizontal strut 32 to pass through opening 286. Once strut 32 has passed through opening 286, portions 280*c* return to the undeflected configuration and cooperate with tabs 282 and undersurface 278 of shelf base 268 to grasp horizontal strut 32 so that tray 224 is mounted to step stool 22.

Shelf 252 includes a pair of reinforcing webs 212 that integrally connect each mounting clip to shelf base 268. Webs 212 help to rigidify mounting clips 280 so that portions 280*a*, 280*b* are prevented from deflecting along with portion 280*c* when tray 224 is hooked onto horizontal strut 32 of step stool 22.

Each mounting clip 280 cooperates with undersurface 278 of shelf base 268 to provide a curved surface 283 that engages strut 32 when tray is mounted to step stool 22. When tray 224 is attached to strut 32, curved surfaces 283 provide rotative bearing engagement between tray 224 and strut 32 allowing tray 224 to pivot between a use position that is similar to the use position of tray 24 and a storage position that is similar to the storage position of tray 24.

When tray 224 is in the use position, front support surface 274 of each support arm 264, 266 engages rear surface 116 of respective legs 34 and mounting clips 280 grasp horizontal strut 32 to support tray 224 in the use position. When tray 224 is in the storage position, top support surface 276 of each support arm 264, 266 engages front surface 118 of respective legs and mounting clips 280 grasp horizontal strut 32 to hold tray 224 in the storage position. Engagement of support arms 264, 266 with legs 34 limits the angle through which tray 224 can pivot relative to horizontal strut 32. In addition, the alignment of support arms 264, 266 with respective legs 34 requires that tray 224 be pivoted over the top of horizontal strut 32 through an angle that is greater than one hundred eighty degrees (180°) when tray 224 is moved between the use and storage positions.

Front support surfaces 274 of support arms 264, 266 are each oriented at an angle 320 relative to a bottom surface 322 of each support arm 264, 266 as shown in FIG. 20. Angle 320 between front support surfaces 274 and bottom surfaces 322 of respective support arms 264, 266 compensates for the angle of legs 34 relative to the floor and maximizes the area of contact between front support surfaces 274 and rear surfaces 116 of legs 34. In addition, front support surfaces 274 of each support arm 264, 266 are spatially oriented relative to work surface 254 and relative to front and rear edges 260, 262 of shelf 252 so that work surface 254 faces generally upwardly when tray 224 is in the use position having front surfaces 274 of support arms 264, 266 engaging respective rear surfaces 116 of front legs 34.

Each support arm 264, 266 is formed to include a catch lip 324 adjacent to front support surfaces 274 as shown in FIG. 19. When tray 224 is in the use position, each catch lip 324 extends forwardly past respective rear surfaces 116 of legs 34 so that catch lips 324 cradle U-shaped frame member 28 and limit the amount by which tray 224 can horizontally slide relative to horizontal strut 32.

When tray 224 is in the storage position having top support surface 276 of each support arm 264, 266 engaging front surface 118 of a respective leg 34, tray 224 is supported in parallel relation with legs 34. In addition, front support surfaces 274 of support arms 264, 266 and front edge 262 of shelf 252 face generally upwardly while mounting clips 280 hook over the top of strut 32 when tray 224 is in the storage position so that tray 224 hangs generally downwardly from strut 32.

Tray 224 is configured so that shelf base 268 can pass between legs 34 of U-shaped frame member 28 when tray 224 pivots between the use position and the storage position. Of course, support arms 264, 266 cannot pivot between legs 34 because tray 224 is configured so that support arms 264, 266 engage respective legs 34 of U-shaped frame member 28 when tray 224 reaches the storage position.

As a result of the offset arrangement of support arms 264, 266 relative to shelf 252, work surface 254 of shelf 252 is positioned to lie behind U-shaped frame member 28 and support arms 264, 266 are positioned to lie in front of U-shaped frame member 28 when tray 224 is in the storage position. In addition, first and second spacers 263, 265 of tray 224 are positioned to lie adjacent to respective legs 34 of U-shaped frame member 28. The proximity of first and second spacers 263, 265 with respective legs 34 of U-shaped frame member 28 limits the amount by which tray 224 can horizontally slide relative to horizontal strut 32 when tray 224 is in the storage position.

When tray 224 is in the storage position, elbow portions of U-shaped frame member 28 are positioned to lie adjacent to respective curved walls 292 of first and second sides 256, 258 of shelf 252 and each elbow portion extends through a respective pocket 296 of tray 224. Extension of elbow portions of U-shaped frame member 28 through respective pockets 296 of tray 224 prevents tray 224 from being detached from step stool 22 because first and second spacers 263, 265 of tray 224 engage the elbow portions to prevent upward lifting of tray 224 relative to horizontal strut 32.

When tray 224 is detached from step stool 22, tray 224 can be placed on a flat table surface 210 so that bottom surfaces 322 of support arms 264, 266 flushly engage table surface 210 and so that shelf 252 is stably supported by support arms 264, 266 and spacers 263, 265 in vertical spaced-apart relation with table surface 210. When tray 224 sets on table surface 210, shelf 252 is horizontal having work surface 254 facing upwardly so that objects (not shown) can be placed on work surface 254 and retained by retaining wall 270.

Although the invention has been described in detail with reference to certain preferred embodiments and specific examples, variations and modifications exist within the scope and spirit of the invention as described and as defined in the following claims.

We claim:

1. A ladder assembly comprising a frame including a frame member having a horizontal strut and a leg extending therefrom, and a tray including a shelf, a mounting clip fixed to the shelf, and a tray support fixed to the shelf, the mounting clip and a portion of the shelf defining a curved surface, the curved surface providing rotative bearing engagement between the tray and the horizontal strut during pivoting movement of the tray relative to the horizontal strut between a use position wherein the shelf extends horizontally away from the frame member and a storage position wherein the shelf is positioned to lie adjacent to the frame member, the tray support including a spacer coupled to the shelf and a support arm coupled to the spacer, the support arm including a first support surface that engages the leg when the tray is in the use position to support the tray in the use position, the support arm including a second support surface that engages the leg when the tray is in the storage position, the spacer positioning the support arm so that the first support surface of the support arm is horizontally and vertically spaced apart from the curved surface, the leg of the frame member including a rear surface and a front surface opposite to the rear surface, the first support surface of the support arm engages the rear surface of the leg when the tray is in the use position, and the second support surface of the support arm engages the front surface of the leg when the tray is in the storage position, the mounting clip and spacer extend downwardly away from the shelf in the use position, the shelf including a front edge, a rear edge spaced apart from the front edge, and a shelf base extending between the front and rear edges, the mounting clip being fixed to the shelf base adjacent to the front edge of the shelf, the spacer being fixed to the shelf base adjacent to the rear edge of the shelf, the mounting clip including a distal end spaced apart from the shelf, the frame having a cross-sectional shape being received between the distal end of the mounting clip and the shelf when the tray is attached to and detached from the frame, the shelf further including a tab, the tab cooperating with the distal end of the mounting clip to define an opening that is smaller than the cross-sectional shape of the frame, the mounting clip being made of a resilient material that deflects to expand the opening allowing the frame to pass between the tab and the mounting clip when the tray is attached to and detached from the frame, and the tab being inwardly spaced from the spacer.

2. The ladder assembly of claim 1, wherein the shelf includes an undersurface facing in a first direction and the second support surface of the support arm faces in a second direction opposite to the first direction.

3. The ladder assembly of claim 2, wherein the shelf includes a work surface facing in the second direction and the second support surface of the support arm extends laterally beyond the work surface of the shelf.

4. The ladder assembly of claim 1, wherein the front edge of the shelf faces in a first direction, the first support surface of the support arm faces substantially in the first direction, and the first support surface is spaced apart from the front edge of the shelf.

5. The ladder assembly of claim 4, wherein the curved surface includes a portion that faces in a second direction opposite to the first direction.

6. The ladder assembly of claim 1, wherein the mounting clip is positioned between the shelf base and the second support surface of the support arm.

7. The ladder assembly of claim 6, wherein the front edge of the shelf faces in a first direction and extends away from the undersurface of the shelf, the first support surface is positioned below the front edge of the shelf when the tray is in the use position.

8. The ladder assembly of claim 6, wherein the first support surface of the support arm faces substantially in a first direction, the mounting clip includes a first portion extending away from the undersurface of the shelf, the first portion defining a portion of the curved surface that faces in a second direction opposite to the first direction.

9. The ladder assembly of claim 1, wherein the shelf includes a substantially flat work surface, the curved surface and the support arm cooperate to support the work surface above the horizontal strut when the tray is in the use position, and the curved surface and the support arm cooperate to position the work surface below the horizontal strut when the tray is in the storage position.

10. The tray of claim 3, wherein the second support surface of the support arm is substantially parallel with the work surface of the shelf.

11. The tray of claim 1, wherein the mounting clip is positioned between the shelf base and the support arm.

12. The ladder assembly of claim 1, wherein the support arm cooperates with the spacer and the shelf to define a pocket that receives the frame when the tray is in the storage position.

13. The ladder assembly of claim 1, wherein the frame member is U-shaped.

14. The ladder assembly of claim 1, wherein the horizontal strut cross-section is substantially round.

15. The ladder assembly of claim 1, wherein the the curved surface engages the horizontal strut so that in the use of the position the shelf base is positioned on a first side of the horizontal strut and the support arm is positioned on a second side of the horizontal strut.

16. The ladder assembly of claim 1, wherein the rear edge of the shelf is positioned in horizontal relation with the horizontal strut of the frame member when the tray is in the use position, the rear edge of the shelf is positioned above the horizontal strut of the frame member when the tray is at an upright position between the use position and the storage position, and the rear edge of the shelf is positioned below the horizontal strut of the frame member when the tray is in the storage position.

17. The ladder assembly of claim 1, wherein the frame member is U-shaped, the shelf includes a substantially flat work surface, the horizontal strut and the leg of the U-shaped frame member define a first plane that cooperates with the work surface of the shelf to define a first included angle when the tray is in the use position, the first support surface of the support arm defines a second plane that cooperates with the work surface of the shelf to define a second included angle, and the first included angle is substantially equivalent to the second included angle.

18. The ladder assembly of claim 1, wherein the spacer positions the support arm so that the first support is below the curved surface when the tray is in the use position.

19. The ladder assembly of claim 18, wherein the frame includes a first side and a second side opposite to the first side, the curved surface includes a portion that engages the first side of the frame when the tray is in the use position, and the spacer positions the support arm so that the first support surface engages the second side of the frame when the tray is in the use position.

20. The ladder assembly of claim 1, wherein the shelf base provides a portion of the curved surface.

21. The ladder assembly of claim 1, wherein mounting clip cooperates with the shelf base to provide the curved surface.

22. The ladder assembly of claim 8, wherein the mounting clip includes a second portion curving away from the first portion of the mounting clip toward the rear edge of the shelf.

23. The ladder assembly of claim 8, wherein the first portion of the mounting clip extends away from the shelf base in substantially parallel relation with the front edge of the shelf.

24. The ladder assembly of claim 22, wherein the mounting clip includes a third portion extending away from the second portion in substantially parallel relation with the shelf base.

25. The ladder assembly of claim 24, wherein the third portion of the mounting clip is positioned below the horizontal strut when the tray is in the use position, and the first portion of the mounting clip is positioned above the horizontal strut when the tray is in the storage position.

* * * * *